US010946653B2

(12) United States Patent
Giusti et al.

(10) Patent No.: US 10,946,653 B2
(45) Date of Patent: Mar. 16, 2021

(54) FLUID EJECTION MICROFLUIDIC DEVICE, IN PARTICULAR FOR INK PRINTING, AND MANUFACTURING PROCESS THEREOF

(71) Applicant: STMICROELECTRONICS S.R.L., Agrate Brianza (IT)

(72) Inventors: Domenico Giusti, Caponago (IT); Mauro Cattaneo, Sedriano (IT); Donata Asnaghi, Agrate Brianza (IT)

(73) Assignee: STMICROELECTRONICS S.R.L., Agrate Brianza (IT)

( * ) Notice: Subject to any disclaimer, the term of this patent is extended or adjusted under 35 U.S.C. 154(b) by 0 days.

(21) Appl. No.: 16/414,619

(22) Filed: May 16, 2019

(65) Prior Publication Data

US 2019/0358955 A1 Nov. 28, 2019

(30) Foreign Application Priority Data

May 28, 2018 (IT) ..... 102018000005778

(51) Int. Cl.
*B41J 2/14* (2006.01)
*B41J 2/16* (2006.01)

(52) U.S. Cl.
CPC ..... *B41J 2/14233* (2013.01); *B41J 2/14201* (2013.01); *B41J 2/161* (2013.01); *B41J 2/1623* (2013.01); *B41J 2002/14362* (2013.01)

(58) Field of Classification Search
CPC .... B41J 2/14233; B41J 2/161; B41J 2/14201; B41J 2/1623; B41J 2002/14362
See application file for complete search history.

(56) References Cited

U.S. PATENT DOCUMENTS 5,459,501 A * 10/1995 Lee ..... B41J 2/161 347/68
7,294,536 B2 11/2007 Villa et al.
8,173,513 B2 5/2012 Villa et al.
(Continued)

FOREIGN PATENT DOCUMENTS

EP 1577656 B1 6/2010
WO 2018/004861 A1 1/2018

OTHER PUBLICATIONS

Takahashi, "Adaptability of Piezoelectric Inkjet Head," NIP17: International Conference on Digital Printing Technologies, Sep. 30-Oct. 5, 2001, pp. 323-327.

*Primary Examiner* — Geoffrey S Mruk
(74) *Attorney, Agent, or Firm* — Seed Intellectual Property Law Group LLP

(57) ABSTRACT

The fluid ejection microfluidic device, has a substrate; a buried cavity within the first substrate; a membrane formed by the first substrate and extending between the buried cavity and a first main surface of the substrate; and an access channel extending through the substrate, laterally and externally to the buried cavity and to the membrane and isolated with respect to the buried cavity. A sealed actuation structure extends over the first main surface of the substrate. A containment layer, of polymeric material, extends over the first main surface of the substrate and forms a fluid containment chamber accommodating the sealed actuation structure. A nozzle body of semiconductor material closes the fluid containment chamber at the top and is traversed by an ejection opening, forming, together with the fluid containment chamber and the access channel, a fluidic path.

21 Claims, 8 Drawing Sheets

(56) References Cited

U.S. PATENT DOCUMENTS

| | | | |
|---|---|---|---|
| 8,998,388 | B2 | 4/2015 | Cattaneo et al. |
| 9,902,152 | B2 | 2/2018 | Eid et al. |
| 2003/0168711 | A1 | 9/2003 | Villa et al. |
| 2005/0208696 | A1 | 9/2005 | Villa et al. |
| 2008/0261345 | A1 | 10/2008 | Villa et al. |
| 2014/0313264 | A1 | 10/2014 | Cattaneo et al. |
| 2017/0144881 | A1 | 5/2017 | Baldo et al. |
| 2017/0182778 | A1 | 6/2017 | Cattaneo et al. |
| 2018/0065371 | A1 | 3/2018 | Cattaneo et al. |
| 2018/0141074 | A1 | 5/2018 | Giusti et al. |
| 2018/0236445 | A1 | 8/2018 | Giusti et al. |

* cited by examiner

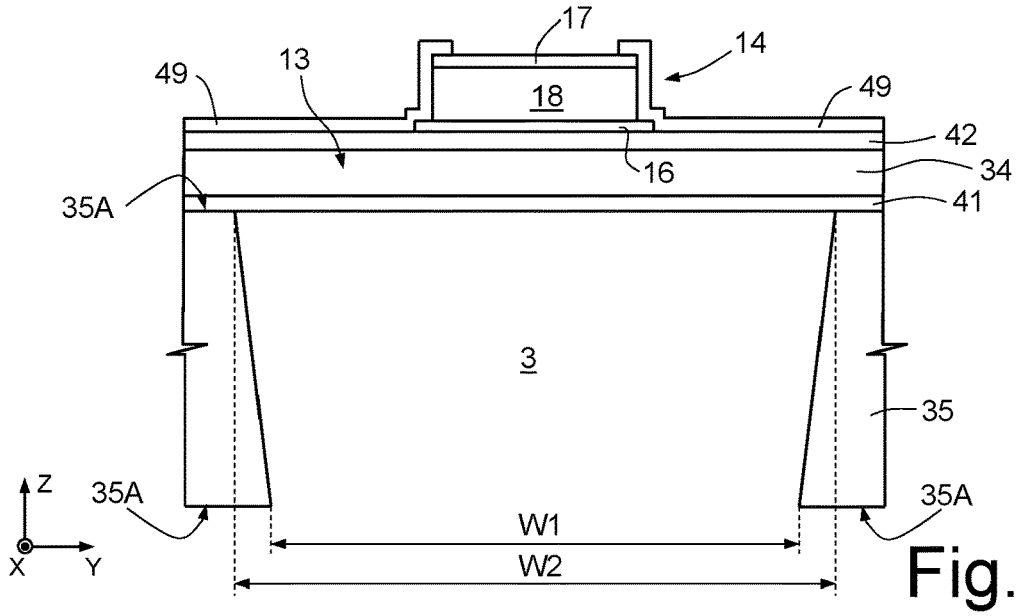
Fig.5
Prior Art
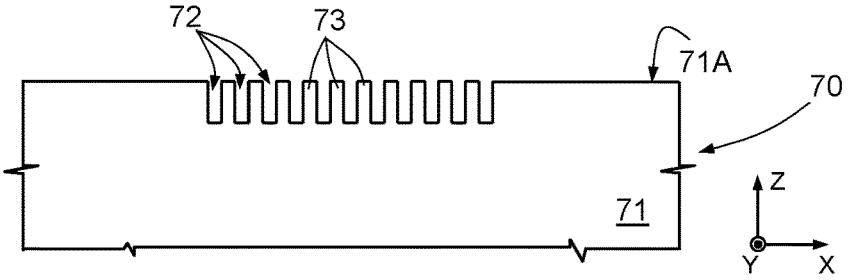
Fig.6
Fig.7
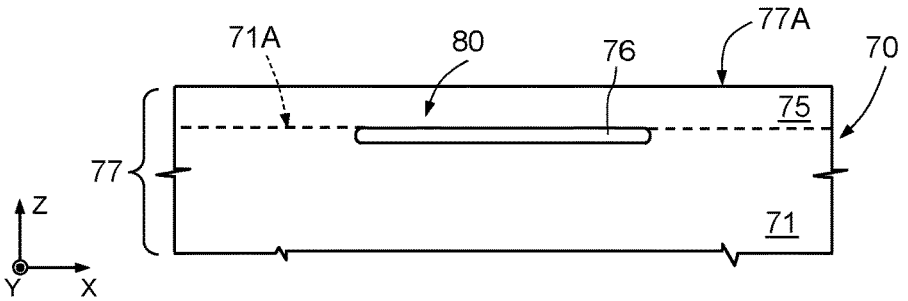
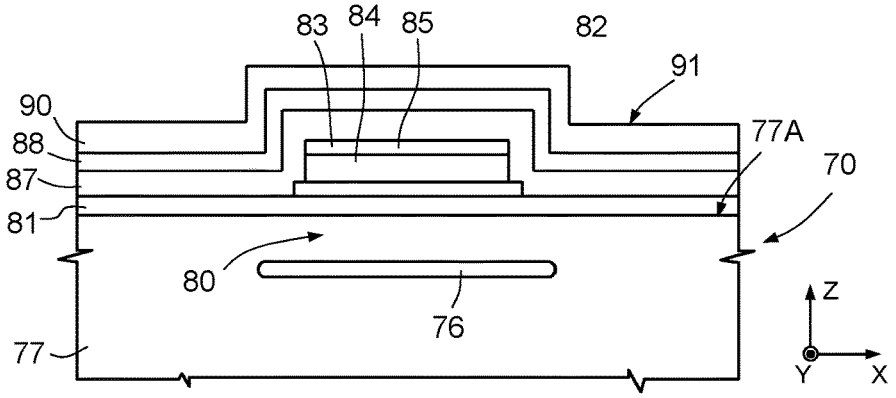
Fig.8

FLUID EJECTION MICROFLUIDIC DEVICE, IN PARTICULAR FOR INK PRINTING, AND MANUFACTURING PROCESS THEREOF

BACKGROUND

Technical Field

The present disclosure relates to a fluid ejection microfluidic device, such as for ink printing, and to the manufacturing process thereof.

Description of the Related Art

As is known, for spraying inks, perfumes, and the like, the use of microfluidic devices of small dimensions has been proposed, that may be manufactured using low-cost microelectronic manufacturing techniques, so called MEMS (Micro-Electro-Mechanical Systems) techniques.

For instance, U.S. Pat. No. 8,998,388 and Italian patent application 102016000118584, filed on Nov. 23, 2016 (corresponding to U.S. Patent Publication No. 2018/0141074) disclose microfluidic devices for spraying ink drops, having the general structure shown in FIG. 1.

FIG. 1 is a perspective view of a cell 2 of a microfluidic device 1 for spraying liquids, sectioned in a plane YZ of a cartesian reference system XYZ. The cell 2 comprises a fluid containment chamber 3 configured to contain a fluid and formed by a chamber layer 4. The containment chamber 3 is delimited at the bottom by a thin layer 5 and at the top by an upper layer 8.

The upper layer 8 houses an outlet channel 10 having a wider portion 10A, facing the fluid chamber 3, and a narrower portion 10B, looking in the opposite direction (towards the outside of the microfluidic device 1).

The thin layer 5 extends over a substrate 11 having an actuator chamber 12, generally vertically aligned to the outlet channel 10. The portion of the thin layer 5 that overlies the actuator chamber 12 forms a membrane or diaphragm 13.

The membrane 13 carries, on its surface facing the actuator chamber 12, an actuator 14. The actuator 14 may be of a piezoelectric type. In this case, it generally comprises two electrodes 16, 17, arranged on top of each other, and an intermediate piezoelectric layer 18, made, for example, of PZT (Lead Zirconate Titanate (Pb, Zr, $TiO_3$), AlN, or an alkaline niobate, such as the material known by the acronym KNN ($K_{05}Na_{05}NbO_3$).

The containment chamber 3 is in fluidic connection with an inlet channel (not visible) through an inlet hole 21, which extends through the thin layer 5 and enables inlet and transport of a fluid within the containment chamber 3.

The microfluidic device 1 generally comprises a plurality of cells 2, connected, through respective inlet holes 21, to a liquid supplying system (not illustrated).

The microfluidic device 1 may be manufactured by connecting three parts, a nozzle plate 23, a membrane plate 24, and a distribution plate 25, as illustrated in FIG. 2.

All the plates 23-25 may be manufactured using micromachining techniques from semiconductor wafers. As illustrated in FIG. 2, the nozzle plate 23 comprises a plurality of nozzles 10 like the nozzle 10 of FIG. 1. The membrane plate 24 corresponds to the chamber layer 4 and to the thin layer 5 of FIG. 1, comprises a plurality of containment chambers 3, such as the containment chamber 3 of FIG. 1, and forms a plurality of membranes 13, such as the membrane 13 of FIG. 1. Finally, the distribution plate 25 corresponds to the substrate 11 of FIG. 1 and forms a plurality of actuator chambers 12 and inlet channels 31, such as the corresponding elements of FIG. 1.

FIG. 3 shows a detailed cross-section, taken in a plane XZ of the cartesian reference system XYZ, of an embodiment of a cell 2 of the microfluidic device 1.

As may be noted, the distribution plate 25 is formed by a main body 30, for example of monocrystalline silicon, passed by two inlet channels 31. The inlet channels 31 communicate with an external tank (not illustrated). The main body 30 forms the actuator chamber 12, arranged between the two inlet channels 31 and isolated from these.

The membrane plate 24 extends over the main body 30 and is bonded to it by a first bonding layer 33. The membrane plate 24 comprises a membrane layer 34 (forming the membrane 13) and a chamber body 35 (defining the containment chamber 3), overlapped to each other; for example, the membrane layer 34 is of polycrystalline silicon, and the chamber body 35 is of monocrystalline silicon. The chamber body 35 has a first surface 35A facing the nozzle plate 23 and a second surface 35B facing the membrane layer 34.

Both surfaces of the membrane layer 34 are covered by insulating layers. In particular, a first insulating layer 41 extends over the surface of the membrane layer 34 facing the main body 30 and is bonded to the first bonding layer 33. A second insulating layer 42 extends over the surface of the membrane layer 34 facing the nozzle plates 23 and is bonded to the chamber body 35. Both insulating layers 41, 42 are of insulating material, such as TEOS (TetraEthyl OrthoSilicate).

The membrane layer 34, the first bonding layer 33, and the insulating layers 41, 42 have respective aligned through openings, forming here two inlet holes 21 in fluidic connection and aligned to the respective inlet channels 31.

The membrane 13 carries, on its surface 13A covered by the first insulating layer 41, a piezoelectric actuator 14 accommodated within the actuator chamber 12. The piezoelectric actuator 14 comprises, stacked on top of each other, the first electrode 16, of electrically conductive material, for example titanium or platinum; the piezoelectric layer 18, for example of PZT; the second electrode 17, for example of TiW (titanium and tungsten alloy); and a dielectric layer 49, for example a composite layer of silicon oxide and silicon nitride deposited by CVD (Chemical Vapor Deposition). In particular, the dielectric layer 49 extends over the sides of the piezoelectric layer 18 and electrically insulates it from contact paths 50, 51, in electrical contact with the first electrode 16 and the second electrode 17, respectively.

The membrane 13 and the piezoelectric actuator 14 form an actuation structure 53 of the cell 2.

The membrane layer 34 moreover carries, on its surface covered by the first insulating layer 41, a pair of contacts 55, of conductive material, arranged laterally to the actuator chamber 12 and accessible on the outside, for electrical connection.

The nozzle plate 23 comprises an outlet layer 56, of semiconductor material, bonded to the chamber body 35 through a second bonding layer 57; a nozzle layer 58, of semiconductor material, bonded to the outlet layer 56 through an insulating layer 59, for example a thermal-oxide layer; and an anti-wettability layer 60, extending over the nozzle layer 58. The layers 56-60 have respective, mutually aligned openings forming the nozzle 10, in fluidic communication with the containment chamber 3. In particular, the wider portion 10A of the nozzle 10 extends through the outlet layer 56 and the narrower portion 10B of the nozzle 10 extends through the nozzle layer 58.

The nozzle plate 23, the membrane plate 24, and the distribution plate 25 are processed separately and subsequently assembled.

In use, in a first step, the piezoelectric actuator 14 is controlled so as to bend downwards to increase the volume of the containment chamber 3 and cause inlet of a precise amount of fluid from the inlet channels 31 and the inlet holes 21 into the containment chamber 3. The piezoelectric actuator 14 is controlled to cause the membrane 13 to bend upwards and bring about controlled ejection of a liquid drop through the nozzle 10.

Manufacture of the cell 2 in three parts, bonded together, may involve difficulties in mutual alignment and thus not always reliably ensure high dimensional precision, which is disadvantageous in applications such as printing heads, as explained hereinafter with reference to FIGS. 4A-4C and 5.

In detail, FIGS. 4A-4C show the sequence of aligning and bonding the plates 23-25, for a single cell 2, with the plates 23-25 shown upside down (with the distribution plate 25 at the top and the nozzle plate 23 at the bottom).

As may be noted (FIG. 4A), initially the three wafers forming the three plates 23-25 are processed separately. In particular, the distribution plate 25 is processed to form the inlet channels 31 and the actuator chamber 12, the membrane plate 24 is processed to form the inlet holes 21 and the actuator 14 (including its connections, not visible), and the nozzle plate 23 is processed to form the nozzles 10.

The membrane plate 24 is bonded to the distribution plate 23 (FIG. 4B).

The other one of the two plates, here the nozzle plate 25, is bonded (FIG. 4C).

During bonding, the critical areas are those to be bonded together, indicated by arrows A in FIG. 4C. In particular, to obtain correct bonding, to properly isolate the actuation chamber 12 from the fluidic path of the liquid being ejected, and to obtain a good flow of this liquid along the fluidic path, it is desirable that possible alignment errors are at most 2 μm.

However, with current manufacturing techniques, according to the precision of the used technology, the alignment errors may range between 7 μm, in the best case, and 30 μm, in the worst case, and thus do not satisfy the desired precision requisites.

In addition, manufacture of the containment chamber 3 by chemical etching of the chamber body 35 in turn leads to imprecisions and errors. In fact, etching to obtain the containment chamber 3 is carried out from the first surface 35A (FIG. 3), to be coupled with the nozzle plate 23 through the second bonding layer 57, after forming the actuation portion 53.

As illustrated in FIG. 5, the cited etching step, which involves a thickness of, for example, 100 μm and is performed via anisotropic chemical etching RIE (Reactive Ion Etching) or other dry silicon etching, causes the containment chamber 3 not to have completely vertical walls, but the latter are slightly inclined. Since current membranes have a rectangular area (as viewed from above, parallel to the plane XY of the cartesian reference system XYZ) with high aspect ratio (length much larger than the width) this is undesirable in particular as regards the smaller, width dimension, where the dimension variation is in percentage terms more important than for the length dimension. In particular, as illustrated in FIG. 5, as a result of the non-vertical etching, the containment chamber 3 has a width W1 that, in a direction parallel to axis Y of the cartesian reference system XYZ (in the plane defined by the first surface 35A of the chamber body 35) is smaller than the width W2 of the containment chamber 3 in proximity of the membrane 13 (in the plane defined by the second surface 35B of the chamber body 35 (W1<W2). In devices obtained using current manufacturing techniques, for thicknesses of the order of a hundred microns, the width difference is typically 6 μm in the best case. This problem is even more evident in case of membranes 13 of cells 2 arranged in peripheral areas of the semiconductor wafer where the membrane plates 24 are formed.

This means that the compliance of the membrane 13 varies a great deal from cell to cell. In particular, it has been noted that 50% of the compliance variations (which cause corresponding undesirable variations of the resonance frequency of the membrane 13) is linked to dimension variations of the membrane. This is particularly undesirable in case of devices intended to form printing heads, which generally comprise thousands of cells 2 arranged adjacent, as may be seen in FIG. 2, where it is desirable that the volume and the speed of the drops ejected is the same for all the cells 2, to obtain a high printing quality.

BRIEF SUMMARY

One or more embodiments are directed to a microfluidic device and a manufacturing process for manufacturing a fluid ejection MEMS microfluidic device. At least one embodiment is directed to a microfluidic device comprising a buried cavity that delimits a membrane.

BRIEF DESCRIPTION OF THE SEVERAL VIEWS OF THE DRAWINGS

For a better understanding of the present disclosure, some embodiments thereof are now described, purely by way of non-limiting example, with reference to the attached drawings, wherein:

FIG. 5 shows an enlarged detail of the ejection cell of FIG. 3, taken in section plane IV-IV;

FIGS. 6-9 are cross-sections of a portion of a semiconductor wafer intended to accommodate an ejection cell, in successive manufacturing steps of the present ejection device;

DETAILED DESCRIPTION

FIGS. 6-15 show successive manufacturing steps of a microfluidic device for ejection of liquids, according to a first embodiment.

Initially, FIG. 6, a buried cavity is formed in a first wafer 70 formed by an initial substrate 71 of monocrystalline semiconductor material such as silicon. For instance, the manufacturing process described in European patent EP 1577656 (corresponding to U.S. Pat. No. 8,173,513) and summarized briefly below may be used for the purpose.

Figure 1:
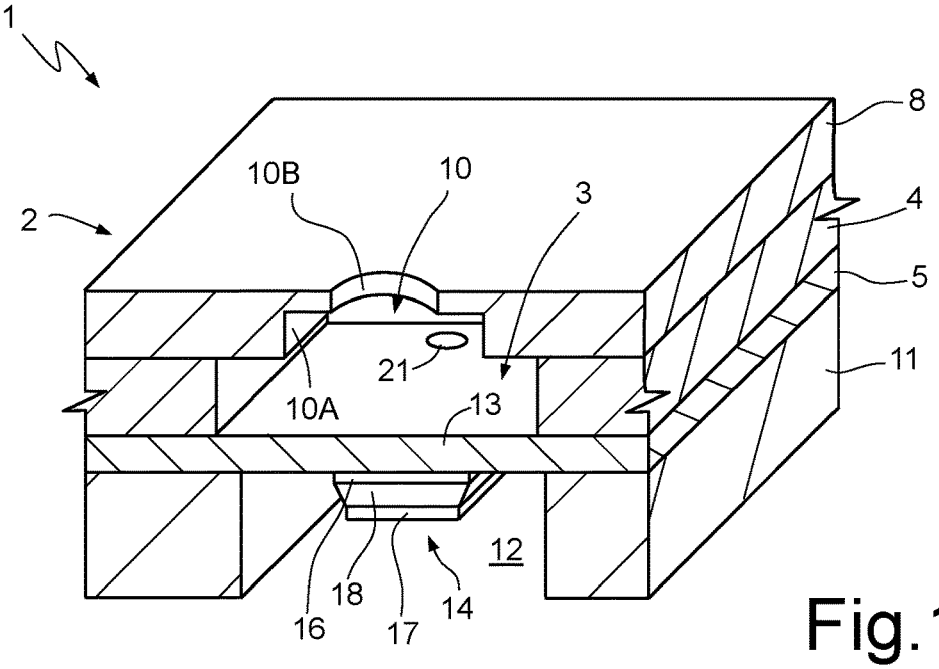
Fig.1 Prior Art
FIG. 1 is a perspective section view of a cell of a microfluidic device of a known type.
Figure 2:
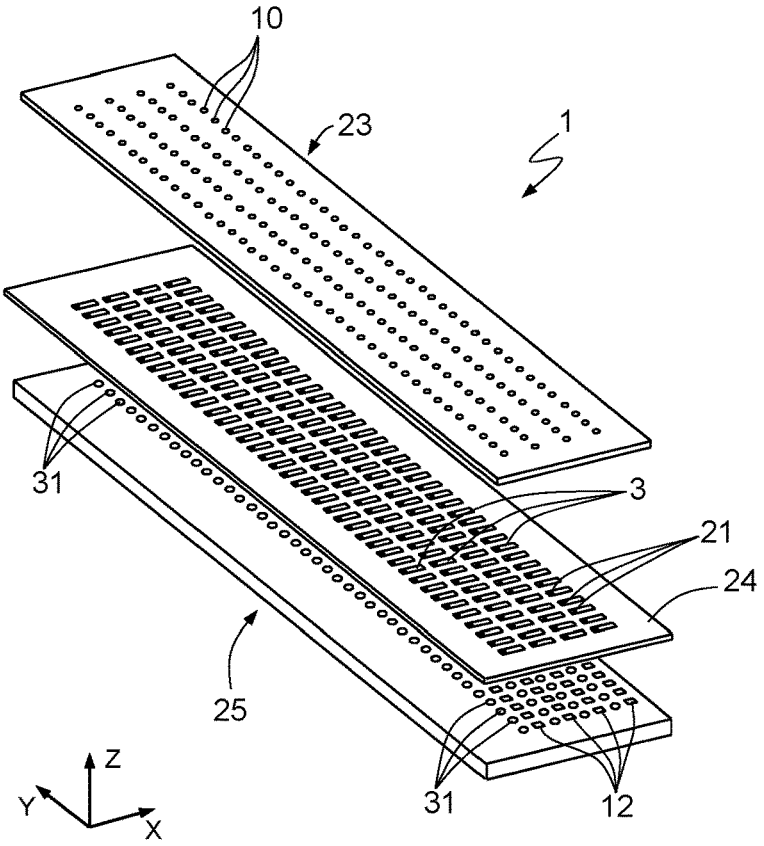
Fig.2 Prior Art
FIG. 2 is an exploded perspective view of a MEMS printing head comprising a plurality of ejection cells of FIG. 2.
Figure 3:
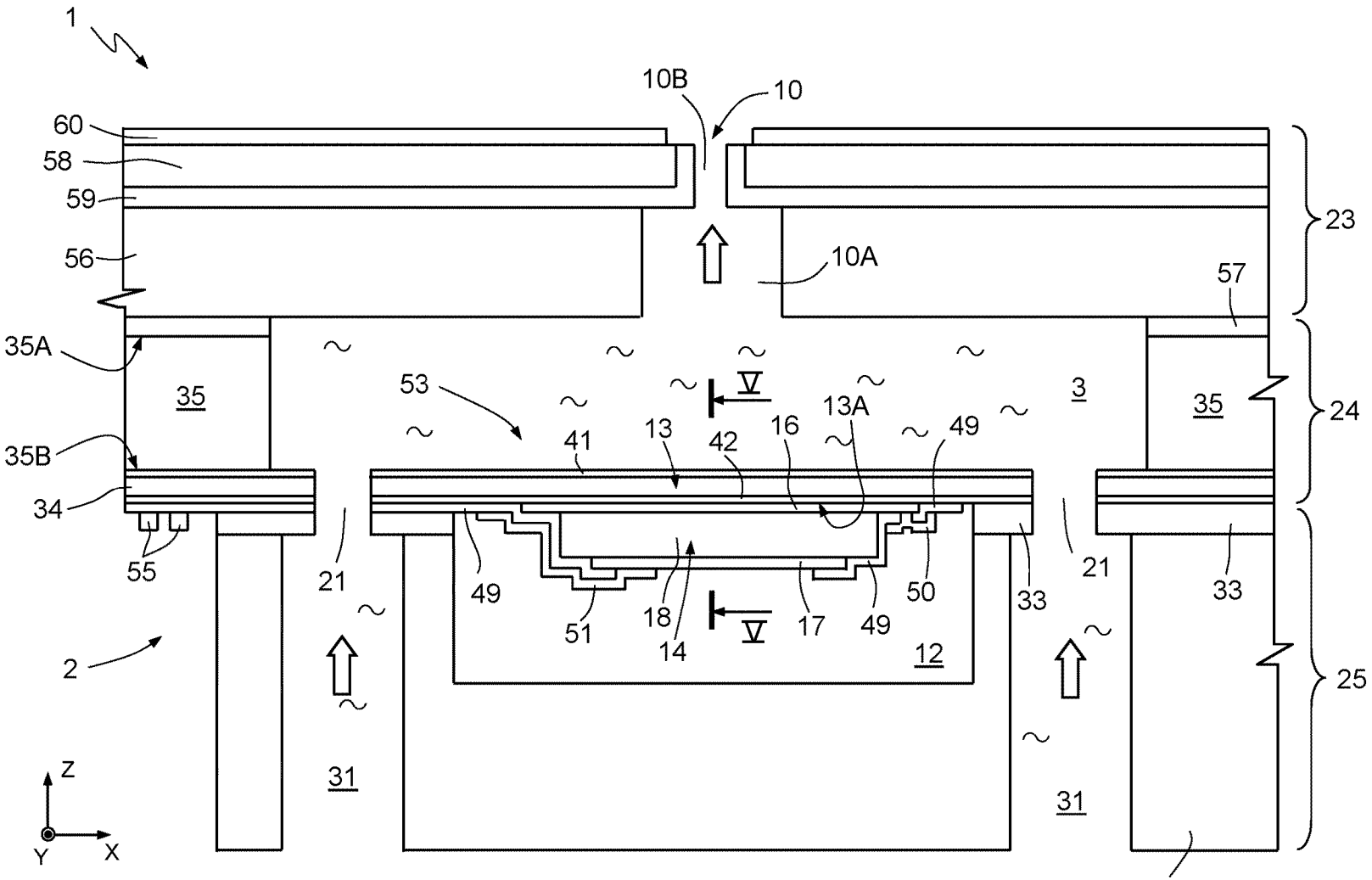
Fig. 3 Prior Art
FIG. 3 is a detailed and enlarged longitudinal section of the ejection cell of FIG. 1.
Figures 4A, 4B, 4C:
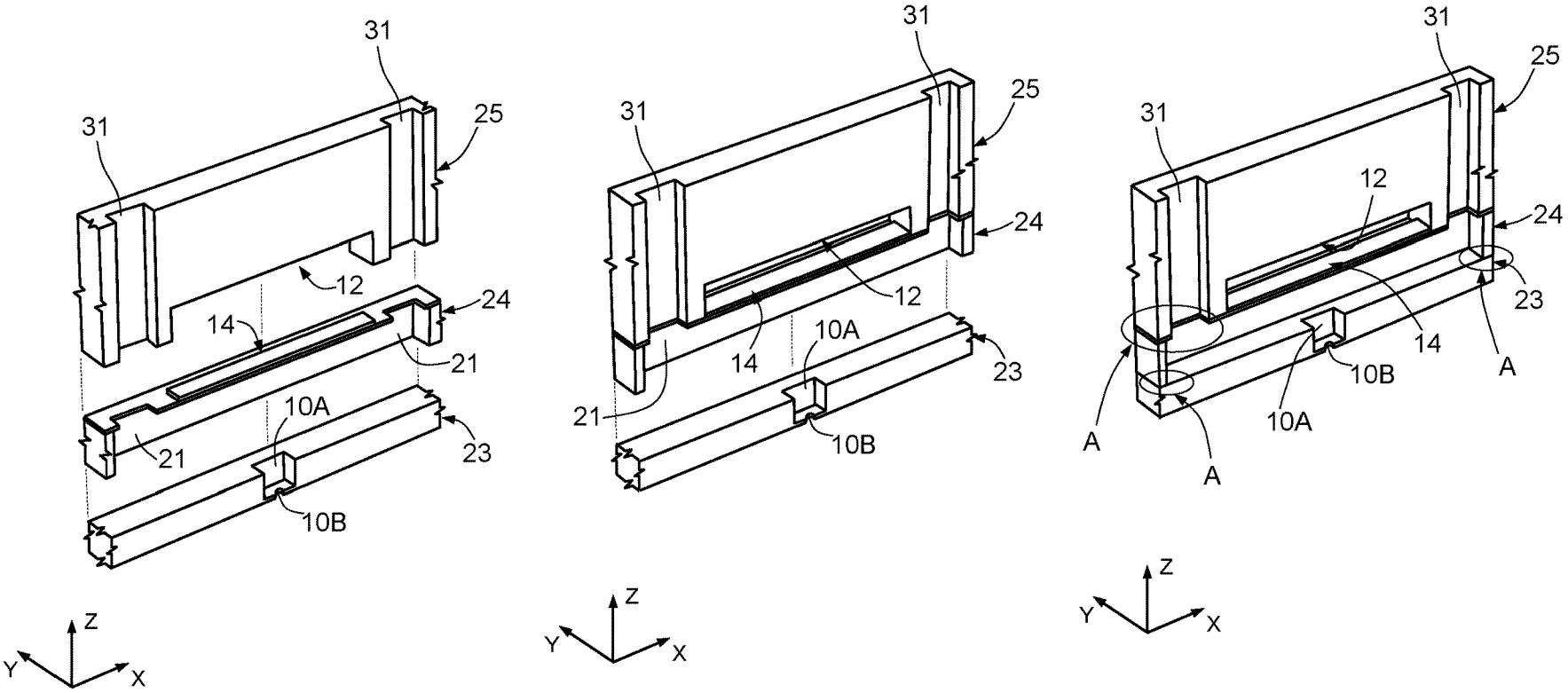
Fig.4C Prior Art
Fig.4B Prior Art
Fig.4A Prior Art
FIGS. 4A-4C are perspective cross-sections of the cell of FIG. 3, in successive manufacturing steps.

In detail, using a resist mask (not illustrated) having honeycomb-lattice openings, an anisotropic chemical etch is carried out on a top surface 71A of the initial substrate 71 so as to form a plurality of trenches 72, which communicate together and delimit a plurality of silicon columns 73. In particular, the plurality of trenches 72 is formed in an area of the initial substrate 71 where the membrane is to be formed (similar to the membrane 13 of FIG. 3).

With reference to FIG. 7, after mask removal (not illustrated), an epitaxial growth is carried out in a reducing environment, starting from the top surface 71A of the initial substrate 71. Consequently, an epitaxial layer 75 grows on the first top surface 71A of the initial substrate 71, closing the trenches 72 at the top. An annealing step is carried out, for example for 30 minutes at 1190° C., preferably in a hydrogen atmosphere, or alternatively a nitrogen atmosphere. As discussed in the above referenced patents, the annealing step causes migration of the silicon atoms, which tend to move into a lower energy position. Consequently, also by virtue of the short distance between the columns 73, the silicon atoms of these completely migrate, and a buried cavity 76 is formed. A thin silicon layer remains over the buried cavity 76, formed in part by epitaxially grown silicon atoms and in part by migrated silicon atoms. At the end of these steps, the initial substrate 71 and the epitaxial layer 75 form a first substrate 77, having a top surface 77A. The thin silicon layer on top of the buried cavity 76 forms a membrane 80. The membrane 80 may have a thickness (in a direction parallel to axis Z of cartesian reference system XYZ) comprised between 5 μm and 10 μm (for example, 6 μm) and an area (in a plane parallel to plane XY of cartesian reference system XYZ) of, for example, 130 μm×750 μm. The buried cavity 76 may have a depth of 3-25 μm, for example, 5 μm.

With reference to FIG. 8, a first insulating layer 81, for example TEOS with a thickness of 0.2 μm, is deposited on the top surface 77A of the first substrate 77. A layer stack is deposited and defined on the first insulating layer 81 to form a piezoelectric actuator 82 comprising a first electrode 83, for example of platinum with a thickness comprised between 30 nm and 300 nm; a piezoelectric region 84, for example, PZT with a thickness comprised between 0.5 and 3 μm, typically 1 or 2 μm; and a second electrode 85, for example TiW, with a thickness comprised between 30 and 300 nm.

Again with reference to FIG. 8, a first passivation layer 87, for example, USG (Undoped Silicon Glass), and a second passivation layer 88, for example, silicon nitride are deposited on the piezoelectric actuator 82 and contact pads are formed for electrical connection to the outside. In detail and in a way not shown, the first passivation layer 87 is deposited and selectively etched to form trenches accessing the first and second electrodes 83, 85. Conductive material, such as metal, for example aluminum or gold, is deposited and patterned to form conductive paths (not illustrated), similar to the contact paths 50, 51 of FIG. 3, for selective access to the electrodes 83, 85. The second passivation layer 88 is deposited and selectively etched, and the contact pads are formed. A protection layer 90 is deposited, for example, polymeric material such as a liquid photoresist, for instance, the material TMMR S2000 LV T-1 produced by Tokyo Ohka Kogyo Co., Ltd., or another patternable dry film, such as the material SINR produced by Shin-Etsu Chemical Co., Ltd., or a resist of the TMMF family produced by Tokyo Ohka Kogyo Co., Ltd. The protection layer 90 may, for example, have a thickness of 100 nm.

In practice, the first insulating layer 81, the first and second passivation layers 87, 88, and the protection layer 90 form a sealing layer stack 91 completely surrounding and protecting the actuator 82. The ensemble of the actuator 82 and of the sealing layer stack 91 is indicated hereinafter as sealed actuation structure 99.

Figure 9:
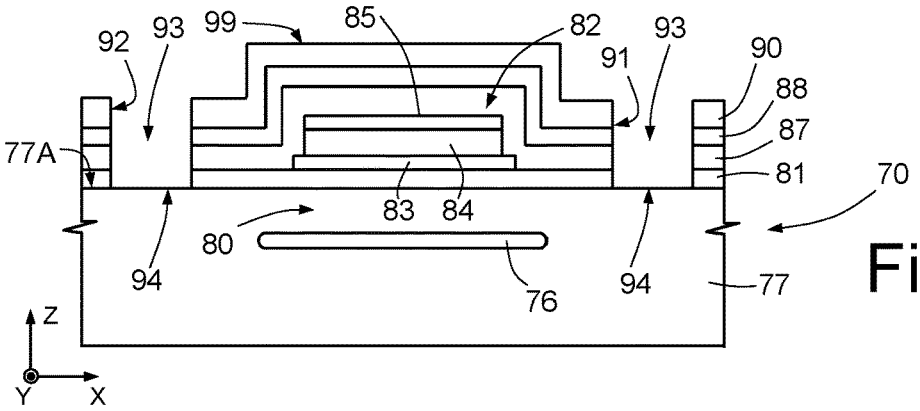
Figure 10:
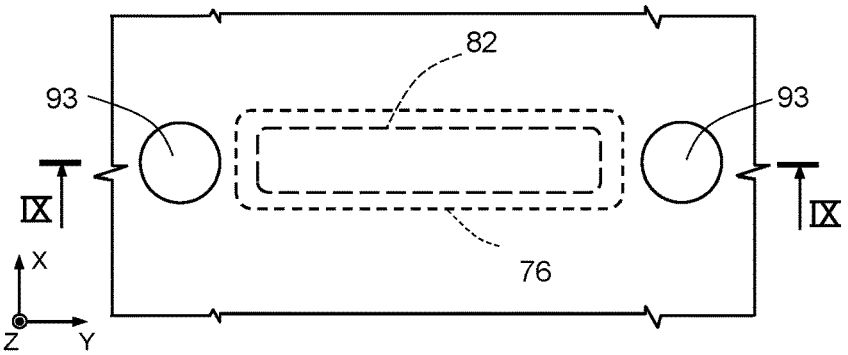
FIG. 10 is a top plan view of the wafer portion of FIG. 9.

With reference to FIG. 9, the protection layer 90 is defined to form two openings 92 on two longitudinally opposite sides of the actuator 82, at a distance therefrom, and to remove it from above the contact pads. The underlying layers, including the first insulating layer 81 and the first and second passivation layers 87, 88, are selectively etched to expose portions 94 of the top surface 77A of the first substrate 77. Two inlet holes 93 are thus formed (see also FIG. 10), intended to form part of a fluidic path for the liquid. As may be noted in particular in FIG. 10, the inlet holes 93 are external to the area occupied by the buried cavity 76 and thus to the membrane 80. This figure also shows the markedly elongated rectangular shape of the membrane 80.

Figure 11:
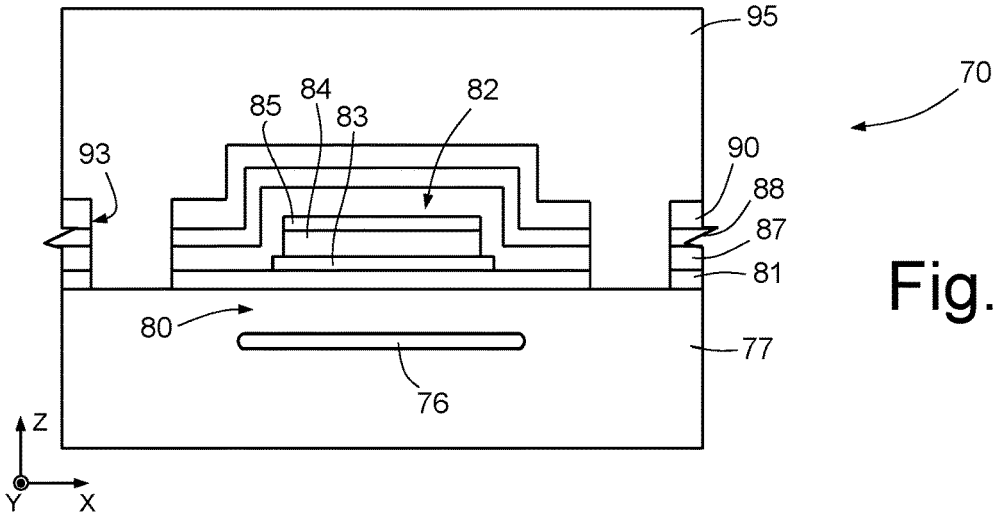
FIGS. 11 and 12 are cross-sections similar to FIGS. 6-9, in successive manufacturing steps.

With reference to FIG. 11, a chamber layer 95 is deposited. The chamber layer 95, which determines the depth of the fluid containment chambers, is photo-patternable polymeric material such as to have good mechanical strength and chemical resistance characteristics. For instance, the chamber layer 95 may be a dry film, such as the material NC-0039A 9600cP produced by Tokyo Ohka Kogyo Co., Ltd., deposited by rolling for a thickness of, for example, 100 μm. Alternatively, the chamber layer 95 may be the material SINR referred to above, or else the material KPM-DFR, forming a permanent adhesive dry film produced by NIPPON KAYAKU Co., Ltd., KPM-DFR Dry-Film, or another packaging photo-patternable material produced by Shin-Etsu Chemical Co., Ltd.

Figure 12:
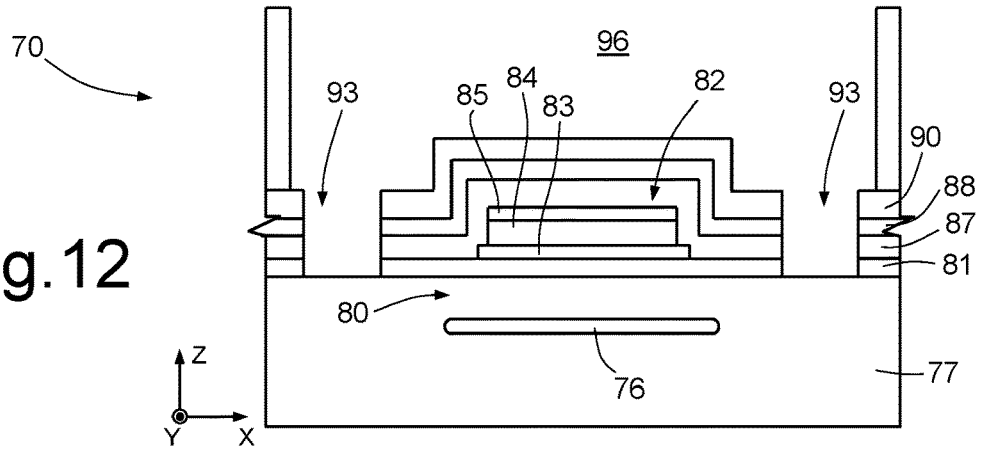
Figure 13:
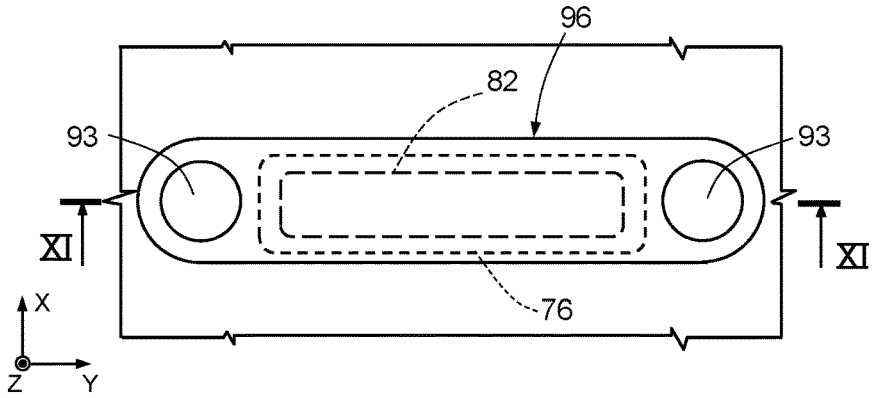
FIG. 13 is a top plan view of the wafer portion of FIG. 12.
Figure 14:
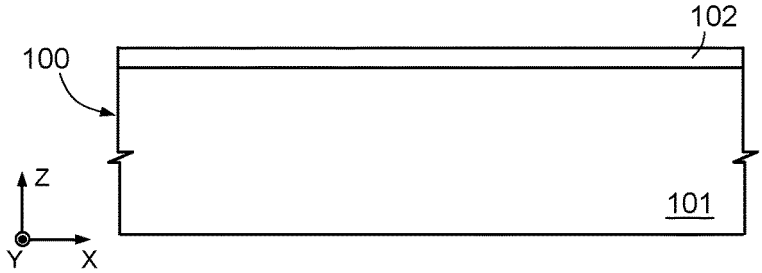
FIGS. 14 and 15 are cross-sections of a portion of a different semiconductor wafer in two manufacturing steps of the present device.

With reference to FIGS. 12 and 13, the chamber layer 95 is defined, using known photolithographic techniques, and removed throughout its thickness above the actuator 82 and also within the inlet holes 93. A containment chamber 96 is thus formed in communication with the inlet holes 93.

Figure 15:
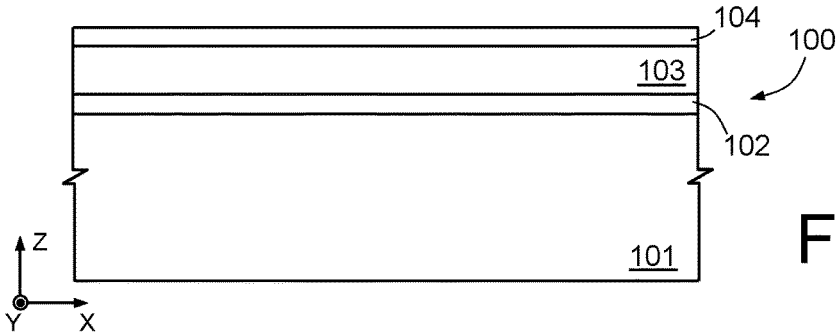

Simultaneously, before or after processing the first wafer 70, a second wafer 100 is processed (FIG. 15). In detail, the wafer 100 comprises a second substrate 101 covered by a dielectric layer 102, for example an oxide layer.

As shown in FIG. 15, a nozzle layer 103 of polycrystalline silicon epitaxially is grown on the dielectric layer 102. The nozzle layer 103 may have a thickness of approximately 25 μm. A second insulating layer 104, for example TEOS with a thickness of approximately 1 μm, is deposited on the nozzle layer 103.

Figure 16:
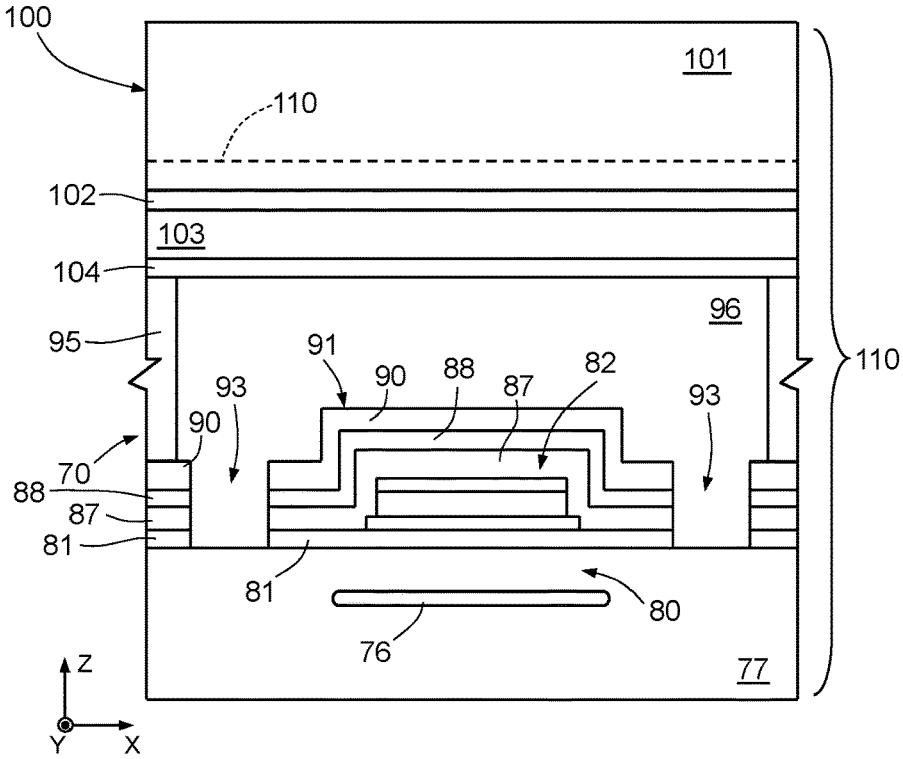
FIGS. 16-19 are cross-sections of a portion of a composite wafer obtained by bonding the wafer of FIG. 12 and the wafer of FIG. 15, in successive manufacturing steps.

With reference to FIG. 16, the first and the second wafers 70 and 100 are coupled together (e.g., using the wafer-to-wafer bonding technique). For instance, the second wafer 100 is flipped over the first wafer 70, applying pressure and heat (for example, inserting the wafers 70, 100 in a vacuum chamber, with a vacuum pressure of less than 1 Pa and a mechanical pressure of 0.1-2 MPa, gradually heating up to 180° C. and keeping the wafers 70, 100 in an oven for 1 h), so that the second insulating layer 104 "sticks" to the chamber layer 95, thus obtaining a composite wafer 110. In this way, the containment chamber 96, delimited at the bottom by the first substrate 77 and laterally by the chamber layer 95, is closed at the top by the second wafer 100. Moreover, the actuator 82 is housed in the containment chamber 96, completely surrounded by the layer stack 91 that isolates it from the liquids present, in use, in the containment chamber 96.

Figure 17:
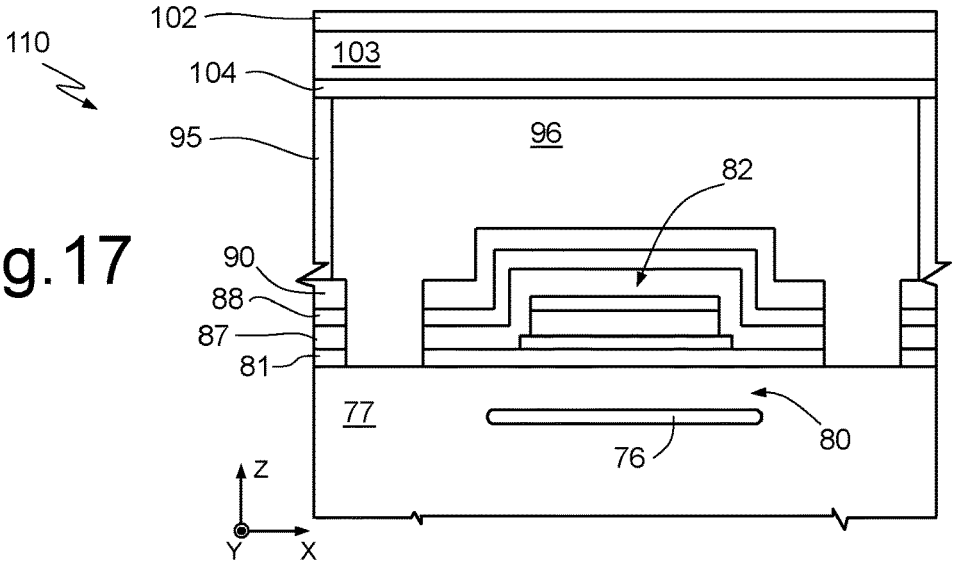

The second substrate 101 is completely removed. To this end, according to an embodiment, the composite wafer 110 is subjected first to mechanical thinning and then to etching. For instance, mechanical thinning may be carried out via grinding so as to remove the second substrate 101 for the majority of its thickness, until a thickness of approximately 10 μm is obtained (as represented schematically in FIG. 16 by line 111). Complete removal of the second substrate 101 may be carried out via isotropic silicon etching using $SF_6$, with automatic etch stop on the dielectric layer 102 so that the composite wafer 110 is thinned out (FIG. 17).

Figure 18:
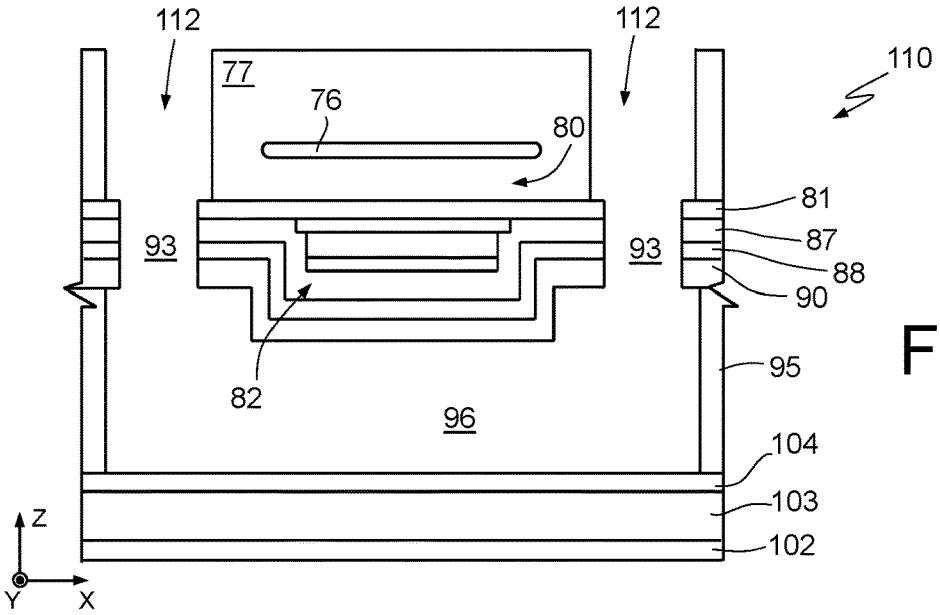

With reference to FIG. 18, the composite wafer 110 is flipped over, the first substrate 77 is masked and selectively removed, in a per se known manner, via deep silicon etching so as to form inlet channels 112 extending throughout the thickness of the first substrate 77, as far as the inlet holes 93 so as to be aligned with the latter.

Figure 19:
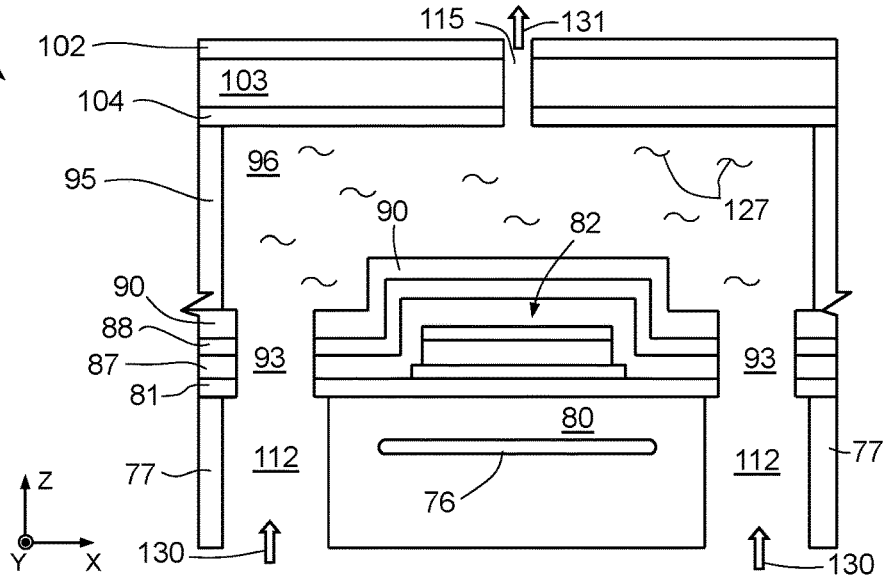

With reference to FIG. 19, the composite wafer 110 is again flipped over and subjected to masking and etching for forming a nozzle 115 completely extends through the layers 102-104 and reaches the containment chamber 96.

The nozzle 115 thus formed, together with the containment chamber 96, the inlet holes 93 and the inlet channels 112, forms a fluidic path 116.

According to a variant (not illustrated), the second wafer 110 is processed as described in Italian patent application 102015000088567 (corresponding to U.S. Patent Publication No. 20180065371), wherein a nozzle (having two portions of different area) is formed in the second wafer 110 prior to bonding to the first wafer 70.

With reference again to FIG. 19, the first substrate 77 is partially cut, in a way not illustrated, to expose the contact pads (not visible), in a per se known manner, and the composite wafer 110 is cut, again in a way not illustrated, for separating different ejection devices (whereof FIG. 19 shows a single microfluidic device, designated by 120).

In use, as represented schematically in FIG. 19 and analogously to known devices, the actuator 82 is controlled to deflect the membrane 80 and cause suction of a liquid or ink 127 from an external tank (not illustrated) through the inlet channels 112 towards the containment chamber 96 (arrows 130); the actuator causes deflection of the membrane 80 towards the inside of the containment chamber 96 and controlled ejection of a liquid drop through the nozzle 115 (arrow 131).

Figure 20:
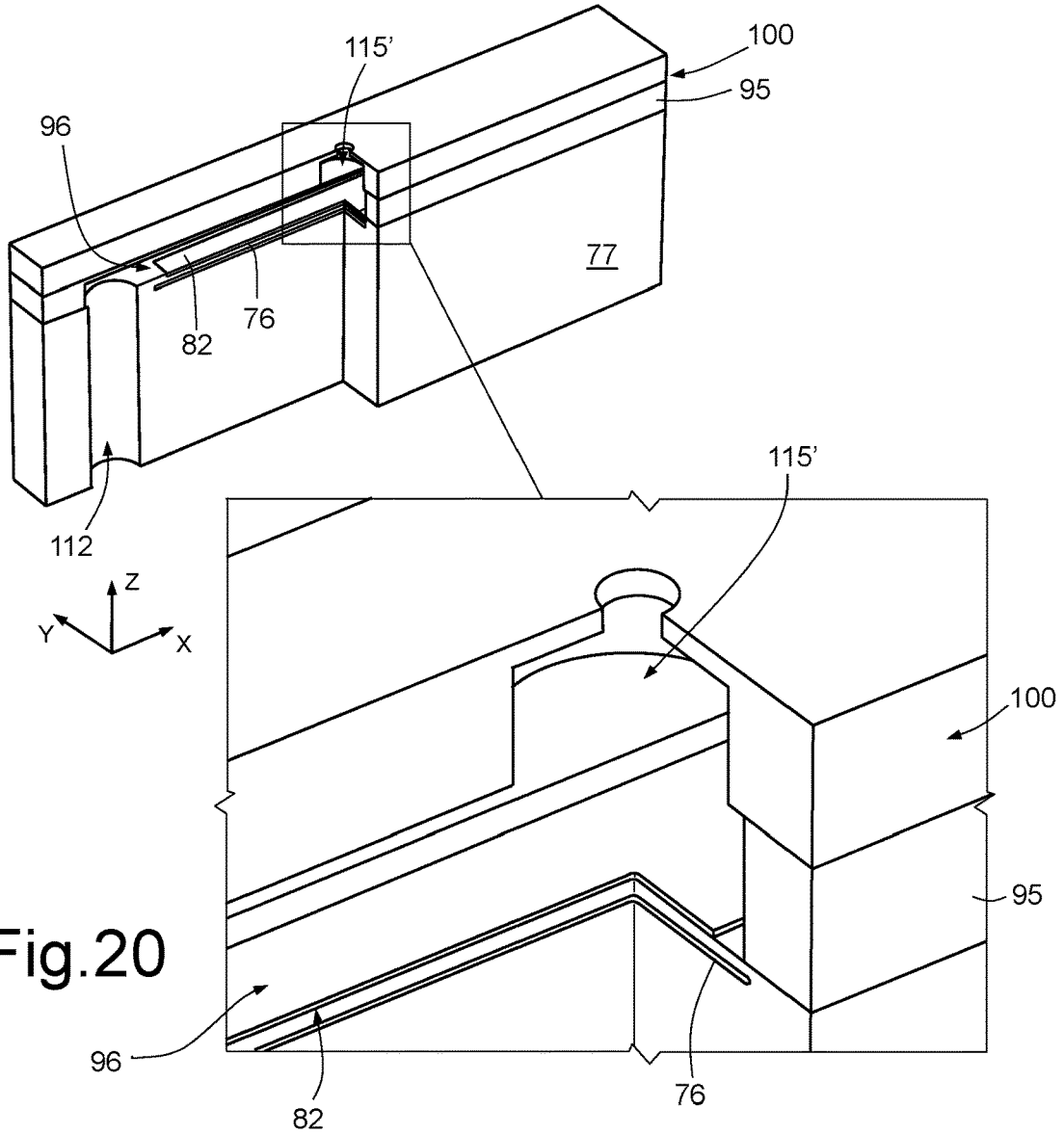
FIG. 20 is a perspective cross-section of a cell of the present device.

FIG. 20 shows a perspective section view of an embodiment of a microfluidic device 120'. In detail, FIG. 20 shows clearly the arrangement of the inlet channel 112, the containment chamber 96, the nozzle (here designated by 115'), the buried cavity 76, and the actuator 82. In the device 120' of FIG. 20, the nozzle 115' is formed according to the variant, referred to above, and described in U.S. Patent Publication No. 20180065371.

In the device 120, 120', alignment errors are small and not critical. In fact, alignment between the buried cavity 76 (and thus the membrane 80, the planar dimensions whereof are determined by the buried cavity 76) and the actuator 82 depends only upon the alignment precision of the photolithographic processes used for defining the actuator 82, which currently enable a precision higher than 0.5 μm to be obtained, and therefore the alignment is much better than in current wafer alignment processes. Moreover, wafer level alignment here regards only alignment between the first wafer 70 and the second wafer 100, which is not very critical, since the nozzle 115, 115' has a much smaller area than the containment chamber 96.

The presence of the buried cavity 76 obtained by epitaxial growth and atom migration, as described above, causes the external perimeter of the buried cavity 76 to have a rounded shape, as may be seen in the enlarged detail of FIG. 19, which reduces the stresses on the membrane 80 as compared to cavities obtained by etching, with approximately vertical walls. This favors deflection of the membrane and enables greater control of the volume of the generated drops.

Formation of the buried cavity 76 in the way described moreover enables a good width and depth accuracy and contributes to a good control over the size of the drops.

The containment cavity 96 is delimited, on the majority of its surface, by polymeric material (protection layer 90, chamber layers 95), which has good resistance to wear and to damage by the liquid, which at times contains aggressive agents, as compared to silicon and semiconductor materials. This limits the problem of wear of the device just to the second wafer 100, which on the other hand is protected by the second insulating layer 104.

The sealing layer stack 91 ensures hermetic sealing of the actuator 82 to the liquid in the containment chamber 96, forming, as said, a sealed actuation structure 99.

With the device 120 it is moreover possible to easily integrate control electronics in the first wafer 70, in particular in the first substrate 77, laterally with respect to the containment chamber 76, in a way not illustrated. For instance, it is possible to use the solution described in Italian patent application No. 102017000019431, filed on Feb. 21, 2017, corresponding to U.S. Patent Publication No. 2018/0236445.

Figure 21:
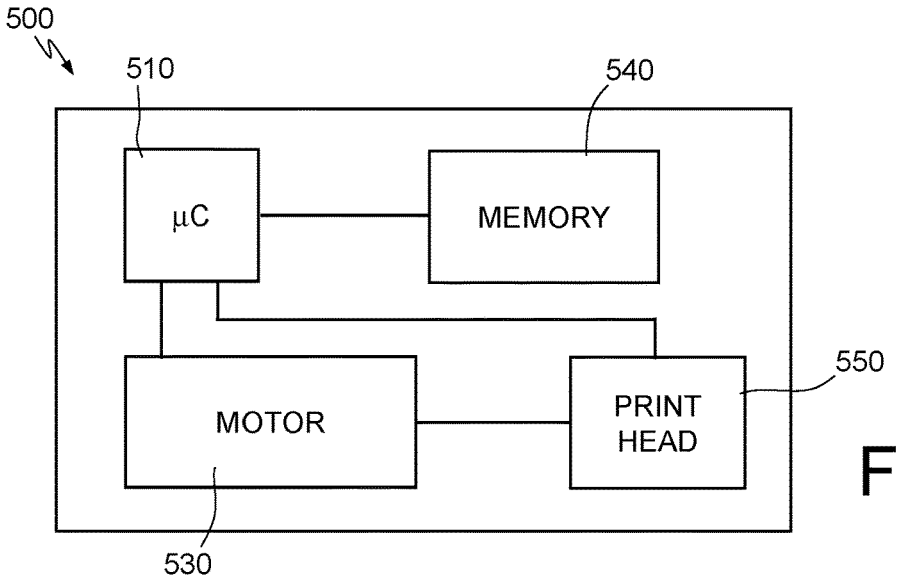
FIG. 21 is a block diagram of a printing head comprising the microfluidic device of FIGS. 6-20.

The microfluidic device 120 may be incorporated in any printer, as is, for example, illustrated in FIG. 21.

In detail, FIG. 21 shows a printer 500 comprising a microprocessor 510, a memory 540 communicatively coupled with the microprocessor 510, a printing head 550, and a motor 530, configured to drive the printing head 550. The printing head 550 may be formed by a plurality of microfluidic devices 120, 120' of FIGS. 19-20, integrated in a single composite wafer 110. The microprocessor 310 is coupled to the printing head 550 and to the motor 530 and is configured to coordinate the movement of the printing head 550 (driven by the motor 530) and to cause ejection of a drop of liquid (for example, ink) from the printing head 550. Ejection of the liquid is carried out by controlling operation of the actuators 82 of different microfluidic devices 120, 120', as described above.

Finally, it is clear that modifications and variations may be made to the microfluidic device and to the manufacturing process described and illustrated herein, without thereby departing from the scope of the present disclosure.

For instance, the materials referred to may be replaced by other materials that have similar chemico-physical and/or mechanical properties.

Moreover, some of the manufacturing steps could vary as regards the order of execution. For example, as referred to above, opening of the nozzle 115 could be performed after bonding the second substrate 110 to the chamber layer 95, or forming the access channel 112 could be performed prior to mutual bonding the first and second wafers 70, 110.

For instance, the actuator might not be of a piezoelectric type.

Further, the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A fluid ejection microfluidic device, comprising:

a substrate of semiconductor material having a first main surface and a second main surface;

an enclosed buried cavity within the substrate;

a membrane formed in the substrate and extending between the enclosed buried cavity and the first main surface;

an access channel between the first and a second main surface of the substrate, the access channel located laterally and externally with respect to the enclosed buried cavity and the membrane, wherein the access channel is isolated from the enclosed buried cavity;

a sealed actuator coupled to the membrane;

a layer of polymeric material coupled to the first main surface of the substrate and forming a chamber;

a nozzle body of semiconductor material coupled to the layer of polymeric material and covering the chamber to form a fluid containment chamber, wherein the sealed actuator is in the fluid containment chamber, wherein the fluid containment chamber is fluidically coupled to the access channel; and an ejection opening extending through the nozzle body, wherein the ejection opening is fluidically coupled to the fluid containment chamber and forms, together with the fluid containment chamber and the access channel, a fluidic path.

2. The device according to claim 1, wherein the sealed actuator comprises a piezoelectric actuator and a sealing layer stack covering the piezoelectric actuator.

3. The device according to claim 2, wherein the sealing layer stack comprises a polymeric protective layer over and at least partially along side surfaces of the piezoelectric actuator.

4. The device according to claim 3, wherein the polymeric protective layer is a patternable dry film.

5. The device according to claim 1, wherein the layer of polymeric material is photoresist.

6. The device according to claim 1, wherein the enclosed buried cavity has rounded lateral outer edges.

7. The device according to claim 1, wherein the sealed actuator is located in the fluid containment chamber.

8. A process for manufacturing a fluid ejection microfluidic device, comprising:

forming, in a first substrate of semiconductor material having a first main surface and a second main surface, an enclosed buried cavity delimiting a membrane between the enclosed buried cavity and the first main surface of the first substrate;

forming a sealed actuation structure on the membrane;

forming an access channel extending between the first and second main surfaces of the first substrate, in a lateral position that is external to the enclosed buried cavity and to the membrane;

forming, on the first main surface of the first substrate, a containment layer, of polymeric material, laterally delimiting a fluid containment chamber surrounding the sealed actuation structure;

bonding a nozzle body of semiconductor material to the containment layer and closing the fluid containment chamber at the top; and forming an ejection opening extending through the nozzle body, the ejection opening facing and being in fluidic communication with the fluid containment chamber to form a fluidic path together with the fluid containment chamber and the access channel.

9. The process according to claim 8, wherein forming the enclosed buried cavity comprises:

forming, within a first wafer of monocrystalline semiconductor material, trenches extending from a face of the first wafer and thereby forming columns of semiconductor material;

epitaxially growing, from the columns, a closing layer of semiconductor material; and carrying out a thermal treatment and causing migration of the semiconductor material of the columns towards the closing layer.

10. The process according to claim 8, wherein forming a sealed actuation structure comprises forming a sealing layer stack and a piezoelectric actuator, the sealing layer stack completely surrounding the piezoelectric actuator and insulating the piezoelectric actuator with respect to the fluid containment chamber.

11. The process according to claim 10, wherein forming a sealing layer stack and a piezoelectric actuator comprises:

forming a first insulating layer on the first substrate;

forming the piezoelectric actuator on the first insulating layer; and forming a polymeric protective layer on top and laterally to the piezoelectric actuator.

12. The process according to claim 11, wherein the polymeric protective layer is a patternable dry film.

13. The process according to claim 11, wherein forming an access path comprises forming a through opening in the sealing layer stack, alongside the piezoelectric actuator before bonding the nozzle body, and, before or after bonding the nozzle body, the access channel being in fluidically coupled to the through opening.

14. The process according to claim 8, wherein forming the containment layer comprises depositing a blanket containment layer by rolling and selectively removing portions of the blanket containment layer to form the containment chamber.

15. The process according to claim 14, wherein the containment layer is at least one material chosen among photoresist and a patternable dry film.

16. The process according to claim 8, comprising, prior to bonding the nozzle body, forming a dielectric layer on a second substrate;

growing a nozzle layer of semiconductor material on the dielectric layer; and forming a second insulating layer on the nozzle layer, wherein bonding the nozzle body comprises bonding the second insulating layer to the containment layer and removing the second substrate.

17. The process according to claim 16, wherein forming an ejection opening comprises forming an ejection opening extending through the dielectric layer, the nozzle layer, and the second insulating layer.

18. A printing head comprising:

a microprocessor; and a fluid ejection microfluidic device coupled to the microprocessor, the fluid ejection microfluidic device comprising:

a substrate of semiconductor material;

an enclosed buried cavity within the substrate;

a membrane formed in the substrate and delimited by the enclosed buried cavity and the first main surface;

an access channel extending through the substrate, wherein the access channel is fluidically isolated from the enclosed buried cavity;

an actuator coupled to the membrane;

a layer of polymeric material coupled to the substrate and forming a chamber;

a nozzle body of semiconductor material coupled to the layer of polymeric material and covering the chamber;

a fluid containment chamber delimited at least in part by the layer of polymeric material and the nozzle body, wherein the fluid containment chamber is fluidically coupled to the access channel, wherein the actuator is located in the fluid containment chamber; and an ejection opening in the nozzle body, the ejection opening fluidically coupled to the fluid containment chamber and forming a fluidic path with the fluid containment chamber and the access channel.

19. The printing head according to claim 18, wherein the actuator of the fluid ejection microfluidic device is a piezoelectric actuator.

20. The printing head according to claim 18, wherein the fluid ejection microfluidic device includes a sealing layer stack on the actuator.

21. The printing head according to claim 20, wherein the sealing layer stack includes a polymeric layer, and wherein the polymeric layer delimits a surface of the fluid containment chamber.

* * * * *